US007311876B2

(12) United States Patent
Baur et al.

(10) Patent No.: US 7,311,876 B2
(45) Date of Patent: Dec. 25, 2007

(54) DISCOLORATION-RESISTANT TIMEPIECE OR JEWELRY PART

(75) Inventors: Jacques Baur, Genolier (CH); Frédéric Oulevey, Vich (CH); Michèle Saudan, Morges (CH); Denis Vincent, Neuchâtel (CH)

(73) Assignee: Rolex S.A., Geneva (CH)

( * ) Notice: Subject to any disclaimer, the term of this patent is extended or adjusted under 35 U.S.C. 154(b) by 0 days.

(21) Appl. No.: 10/916,853

(22) Filed: Aug. 12, 2004

(65) Prior Publication Data

US 2005/0053514 A1 Mar. 10, 2005

(30) Foreign Application Priority Data

Sep. 4, 2003 (EP) ..... 03405645

(51) Int. Cl.
*C22C 5/02* (2006.01)

(52) U.S. Cl. ..... 420/510; 148/430

(58) Field of Classification Search ..... 148/430; 420/510

See application file for complete search history.

(56) References Cited

FOREIGN PATENT DOCUMENTS

| | | | |
|---|---|---|---|
| CH | 219 711 | | 2/1942 |
| DE | 199 58 800 | | 1/2001 |
| EP | 0904765 | * | 3/1999 |
| EP | 1 227 166 | A1 | 7/2002 |
| EP | 1227166 | * | 7/2002 |
| GB | 2 279 662 | | 1/1995 |
| JP | 54-132425 | A | 10/1979 |
| JP | 54132425 | * | 10/1979 |

* cited by examiner

*Primary Examiner*—Sikyin Ip
(74) *Attorney, Agent, or Firm*—Westerman, Hattori, Daniels & Adrian, LLP.

(57) ABSTRACT

Timepiece or jewelry part manufactured in an alloy containing at least 75% gold by weight, from 21% to 23% copper by weight, and from 1% to 4% platinum by weight.

18 Claims, 2 Drawing Sheets

| Alloy | Au [%] | Cu [%] | Pt [%] | Pd [%] | other [%] | ΔELab (60 j) | F |
|---|---|---|---|---|---|---|---|
| 5N | 750 | 205 | 0 | 0 | 45 (Ag) | 7.0 | 1 |
| 1 | 750 | 205 | 0 | 0 | 45 (Ag) | 6.2 | 1.1 |
| 2 | 750 | 248 | 0 | 0 | 1.8 (Zn) | 6.4 | 1.1 |
| 3 | 750.5 | 244.5 | 0 | 0 | 5 (Al) | 9.6 | 0.7 |
| 4 | 750 | 240 | 0 | 0 | 10 (Nb) | 6.5 | 1.1 |
| 5 | 750.5 | 244.5 | 0 | 0 | 5 (Ta) | 7.9 | 0.9 |
| 6 | 750.5 | 244.5 | 0 | 0 | 5 (Ti) | 7.1 | 1.0 |
| 7 | 750.5 | 249 | 0 | 0 | 0.5 (Si) | 9.0 | 0.8 |
| 8 | 917 | 83 | 0 | 0 | - | 10.0 | 0.7 |
| 9 | 750 | 230 | 0 | 20 | - | 3.2 | 2.2 |
| 10 | 750 | 230 | 20 | 0 | - | 4.3 | 1.6 |
| 11 | 770 | 210 | 20 | 0 | - | 3.1 | 2.3 |
| 12 | 760 | 210 | 30 | 0 | - | 2.4 | 2.9 |
| 13 | 770 | 210 | 0 | 20 | - | 2.5 | 2.8 |
| 14 | 750 | 210 | 0 | 40 | - | 1.7 | 4.1 |
| 15 | 750 | 210 | 20 | 20 | - | 1.9 | 3.7 |
| 16 | 765 | 210 | 25 | 0 | - | 2.9 | 2.4 |
| 17 | 780 | 210 | 10 | 0 | - | 5.8 | 1.2 |
| 18 | 775 | 210 | 15 | 0 | - | 4.1 | 1.7 |
| 4N | 751 | 160 | 0 | 0 | 89 (Ag) | 4.9 | 1 |
| 19 | 770 | 180 | 20 | 0 | 30 (Ag) | 2.8 | 1.8 |
| 20 | 770 | 160 | 20 | 0 | 50 (Ag) | 2.6 | 2.0 |

Tab. I

DISCOLORATION-RESISTANT TIMEPIECE OR JEWELRY PART

CROSS REFERENCE TO RELATED APPLICATIONS

This application claims priority of European Application No. 03405645.7 filed Sep. 4, 2003, which is included in its entirety by reference made hereto.

BACKGROUND OF THE INVENTION

Field of the Invention

The invention relates to a timepiece or jewelry part manufactured in an alloy comprising at least 75% gold and at least 6% copper by weight. More particularly, the invention relates to such a timepiece or jewelry part manufactured in an alloy comprising at least 75% gold and at least 15% copper by weight.

The color of such gold alloys depends on their copper and silver contents. A copper content of greater than 18% and a silver content of around 4% give them a red color. The color changes toward pink and then toward yellow if the copper content decreases from 18% to 15% and then from 15% to 6% and if the silver content increases from 4% to 15%. Color is conventionally defined by a point in the CIELAB space formed by a red/green x-axis, a yellow/blue y-axis and an axis representative of the contrast (cf. Standard ISO 7724 drawn up by the Commission Internationale de l'Eclairage [International Commission on Illumination]). The colors of gold alloys are defined in the trichromatic space according to Standard ISO 8654.

The Applicant has observed that watch cases or bracelets manufactured in these standard gold alloys have a tendency to undergo a progressive modification in their color through the action of tap water, sea water, swimming pool water, salt water or even soapy water.

Document DE-A-19958800 discloses a timepiece or jewelry part manufactured in an alloy comprising between 40% and 80% gold, between 0% and 15% copper, between 1% and 40% silver, between 1% and 15% iron and between 0% and 15% palladium. Iron is alloyed to these elements in order to replace nickel (regarded as allergenic), to limit the content of palladium (regarded as expensive) and to give the alloy a white gold color. The alloy may contain between 0% and 0.5% of any of the following elements: platinum, ruthenium, rhodium, iridium, tungsten or tantalum in order to refine the grain size.

The specialized literature reports an accelerated tarnishing study carried out on an alloy intended for the manufacture of items of jewelry, comprising 75% gold, 12% copper and 12% silver. Tests were carried out in the gas phase or in the liquid phase. Tarnishing was determined quantitatively by the difference in color of the alloy before and after the test. The alloy was exposed to contact with reactants which essentially comprised pure sulfur or sulfur compounds. The observed tarnishing was attributed to the formation of silver sulfide $Ag_2S$ (cf. "Tarnishing of AuAgCu alloys", 43, pp. 48-55, 1992, *Werkstoffe und Korrosion*).

Document CH-219 711 discloses an alloy intended for the manufacture of dental prostheses, which contains between 65% and 75% of a gold/platinum alloy in which the platinum content is between 2% and 5%, between 1% and 6% silver, between 8% and 14% copper, between 8% and 14% cadmium and between 0.1% and 1% zinc. Platinum is alloyed to these elements in order to give this yellow gold alloy good tarnishing resistance and corrosion resistance in the mouth.

Another study related to an alloy comprising at most 71% gold, between 12% and 14% copper, between 7.5% and 25% silver, between 0.6% and 4% platinum and between 0.9% and 3.7% palladium in order to determine the biocompatibility thereof with a view to using it to manufacture dental prostheses. Corrosion tests were carried out at room temperature in an aqueous solution containing lactic acid and sodium chloride, at an acid pH of about 2.3. An increase in the metal ion concentration showed that copper and silver pass into solution. The depletion of the two constituents was confirmed by analysis of the first few atomic layers of the surface of the alloy carried out by Auger spectroscopy. Under the experimental pH conditions, the depletion of the copper appeared to be greater the lower the gold and platinum content. In contrast, the platinum content had no appreciable effect on the dissolution of the silver (cf. "Biocompatibility of dental alloys", 3(10), 2001, *Advanced engineering materials*).

Document GB-A-2 279 662 discloses an alloy intended for watchmaking or jewelry, comprising between 33% and 90% gold, between 0.1% and 2.5% iron, between 0.01% and 62.5% silver, between 0.01% and 62.5% copper and between 0.01% and 62.5% zinc and having a hardness of between 100 and 280 Hv. Iron was alloyed to the other elements of the alloy in order to give it a greater hardness and to prevent grain growth during soldering operations. Moreover, better resistance to color changes was observed in heat treatments. The alloy may contain between 0.01% and 25% palladium, nickel or cadmium, between 0.01% and 10% indium, tin, gallium, cobalt, platinum or rhodium and between 0.01% and 3% iridium, ruthenium, silicon or boron. The alloys provided by way of example all comprise 37.53% gold, 8.70% or 9.20% silver, 42.40% copper, 10.87% or 10.67% or 10.57% or 10.37% zinc and 0.5% or 0.7% or 0.8% or 1% iron.

Finally, a timepiece or jewelry part manufactured in an alloy comprising at least 75% gold and between 15% and 23% copper is known from Japanese Patent Application JP 10245646 published in 1998. The alloy furthermore comprises between 0.3% and 5% palladium in order to have a higher crack resistance when casting the part.

BRIEF SUMMARY OF THE INVENTION

One of the objects of the invention is to improve the resistance to color change of a timepiece or jewelry part manufactured in a gold alloy and exposed, during use, to slightly aggressive aqueous media.

For this purpose, the subject of the invention is a timepiece or jewelry part manufactured in an alloy comprising at least 75% gold and between 15% and 18% copper or at least 18% copper by weight, wherein the alloy also comprises between 0.5% and 4% platinum, with the exclusion of the 0.5% content when the copper content is equal to 15%.

The platinum content makes it possible to increase the resistance to color change of the part exposed to the action of tap water, sea water, swimming pool water, salt water or even soapy water.

The timepiece or jewelry part may be manufactured in an alloy further comprising at most 4% palladium in order to increase the resistance to color change. This is the case, for example, for an alloy of yellow color comprising between 6% and 15% copper.

Other advantages will become apparent in the light of the description of one particular embodiment of the invention, illustrated by the drawings.

Table I gives the discoloration test results obtained on various alloys according to the invention.

DETAILED DESCRIPTION OF THE INVENTION

A 5N control alloy of red color comprising 75% gold, 20.5% copper and 4.5% silver was subjected to a discoloration test. The alloy was immersed in a neutral solution saturated with sodium chloride at a temperature of 40° C. for several tens of days. The color was measured according to Standard ISO 7724. The rate of discoloration is illustrated by curve (a) in FIG. 1. Plotted on the x-axis is the immersion time in days and plotted on the y-axis is the norm of the vector ΔElab connecting the representative points of the color of the alloy in the CIELAB space, at the initial time and after the various immersion times. Over the time period explored, the discoloration appears as a continuous monotonic curve with immersion time.

An alloy of red color according to the invention, comprising 76% gold, 21% copper and 3% platinum, was tested under the same conditions as those of the control alloy. The rate of discoloration is illustrated by curve (b). This shows that the norm of the vector connecting the representative points of the color of the alloy according to the invention at the initial time and after the various immersion times is less than that for the control alloy containing no platinum. In other words, the presence of platinum has increased the discoloration resistance of the alloy according to the invention. Quantitatively, an improvement factor F is defined by the ratio of the color change of the control alloy to the color change of the alloy according to the invention, both changes being considered after the same immersion time. In the present case, the improvement factor is around 3 after an immersion time of 60 days.

RBS (Rutherford Backscattering Spectroscopy) analyses were carried out in order to scan a significant depth 35 of material relative to the path of the light waves in the two alloys tested above, that portion of the reflected light waves determining the color of the alloy.

Figure 2A:
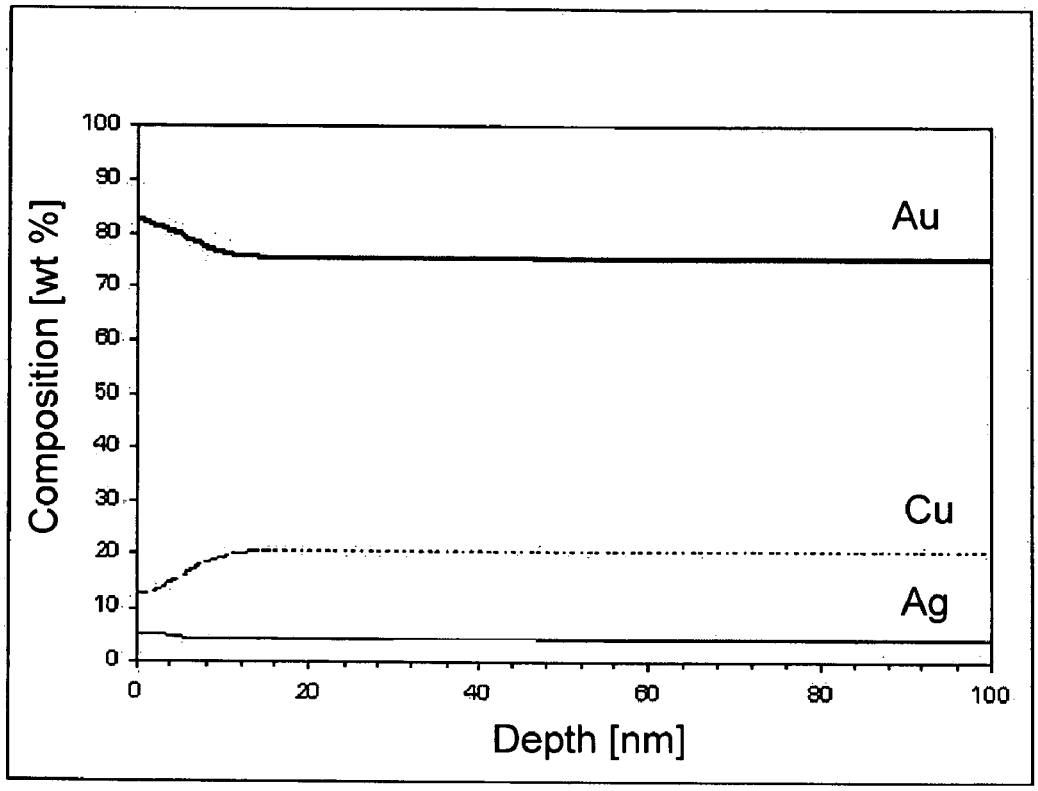
FIGS. 2*a* and 2*b* show two concentration profiles obtained on the respective two alloys that have undergone the discoloration test illustrated by FIG. 1.
Figure 2B:
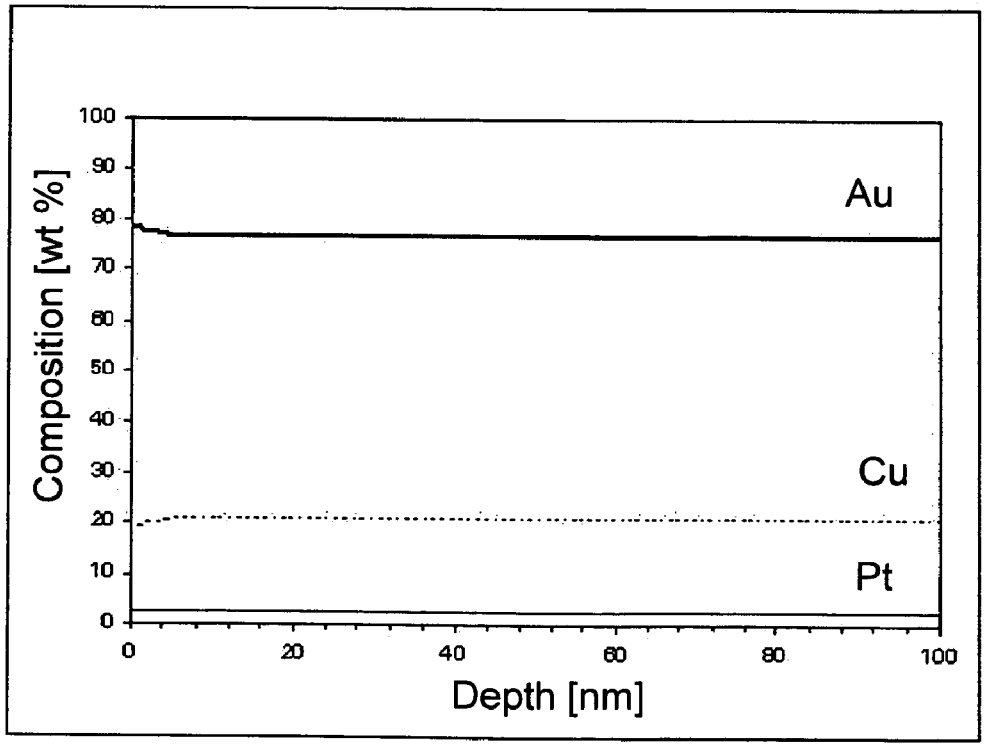

FIGS. 2*a* and 2*b* show the concentration profiles obtained on the control alloy 5N and on the alloy according to the invention, respectively, after 60 days of immersion in the test solution. In the case of the control alloy 5N, FIG. 2*a* shows, with respect to the bulk concentrations of copper and silver, a reduction in the copper concentration proportional with that of the gold over a depth of material between the first ten and the first twenty nanometers, while the silver concentration is maintained over this same depth. In contrast, in FIG. 2*b* the copper concentration in proportion to that of gold decreases less strongly and less deeply in the case of the alloy according to the invention.

It is apparent from these analyses that the discoloration of the control alloy 5N is due to copper dissolving in a deep layer over a few tens of nanometers. The platinum content makes it possible to limit the dissolution of copper in the alloy according to the invention and thus to increase the discoloration resistance of the latter in the test solution.

Figure 1:
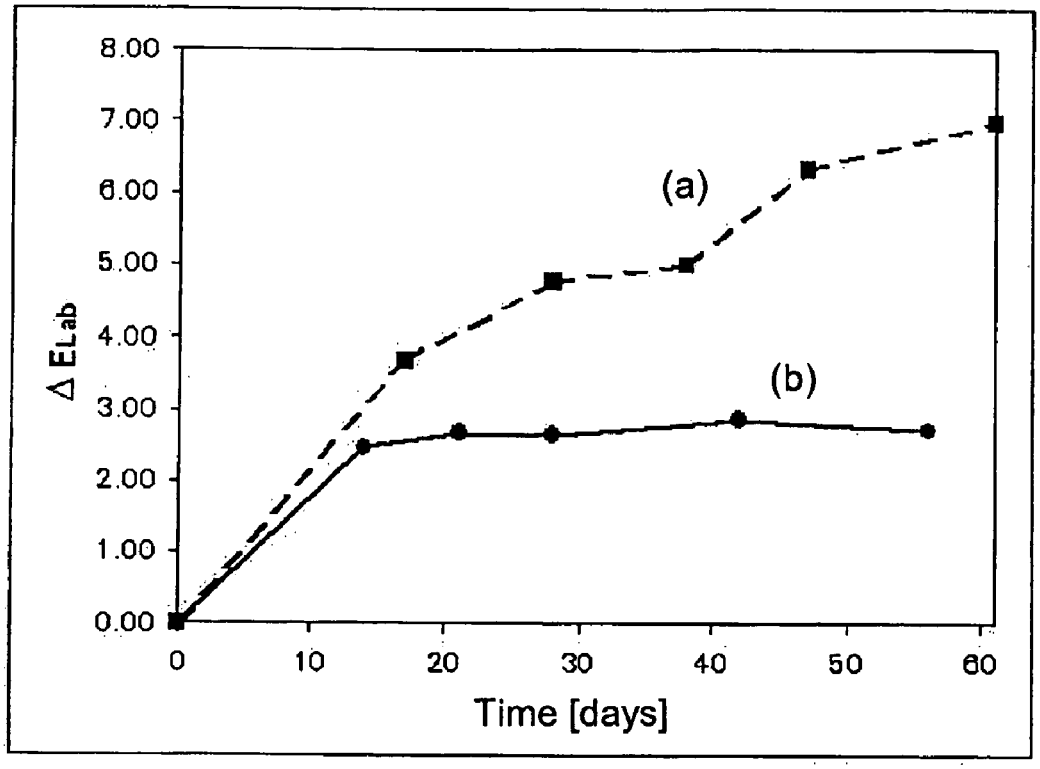
FIG. 1 shows two experimental discoloration curves obtained respectively on a red alloy according to the invention—curve (b)—and on a 5N red alloy according to the prior art—curve (a).

Referring to curve (b) of FIG. 1, the rate of discoloration of the alloy according to the invention tends toward a limiting value after about the fifteenth day. The existence of this limiting value stems from the stable thermodynamic equilibrium that the composition of the alloy gives the material. Such color stabilization of the alloy remains a very unexpected result under the conditions of the discoloration test used. This test may be useful from the industrial standpoint for the finishing of a timepiece or jewelry part manufactured in an alloy comprising, by weight, at least 75% gold, between 15% and 18% copper, or at least 18% copper and between 0.5% and 4% platinum, with the exclusion of the 0.5% content when the copper content is equal to 15%, whereby the part is immersed in a saturated saline solution at neutral pH for a time and at a temperature that are defined in order to achieve the equilibrium value of the color of the part. In general, any solution allowing surface dissolution of copper until the equilibrium color is reached could be used. It should be pointed out that the limiting discoloration value illustrated by curve (b) remains within the eye's limit of perception of a color change of the part.

Table I gives the results of the discoloration test carried out on alloys of various compositions numbered from 1 to 20. The headers of the table indicate the gold, copper, platinum and palladium contents of the alloy, and also the limiting discoloration value ΔELab and the discoloration improvement factor F after a 60 day immersion test. The experimental conditions are the same as those indicated previously, namely immersion in a saturated sodium chloride solution at neutral pH and a temperature of 40 degrees Celsius.

The alloys of the compositions numbered from 20 to 9 in table I typically exhibit a discoloration resistance improvement factor between 1.5 and 4. The alloys denoted by 5N and 4N serve as controls in calculating the improvement factor of alloys 1 to 18 and of alloys 19 and 20, respectively.

An alloy comprising 91.7% gold and 8.3% copper has an improvement factor of less than unity, as indicated by the reference number 8. This result shows that simply seeking an increase in the gold content has an effect of reducing the discoloration resistance of the alloy.

Likewise, the addition of elements such as aluminum, niobium, tantalum, titanium or silicon, for the purpose of forming an oxide layer suitable for limiting the dissolution of copper in the saturated saline solution at neutral pH does not lead to an improvement in the discoloration resistance of the alloys either. In contrast, the alloys whose compositions are numbered from 7 to 3 in table I exhibited an improvement factor of at most 1.

Finally, the results indicated in table I for reference 2 show that the addition of zinc for the purpose of forming a sacrificial anode at the surface of the alloy does not lead to an improvement in the discoloration resistance either.

The improvement factor depends on the weight content of copper in the alloys according to the invention. Preferably, this content is between 20% and 22% for a platinum content of between 1.5% and 3%.

In addition, a platinum content between 0.5% and 4% gives timepieces or jewelry parts according to the invention a color that it was impossible to obtain hitherto. Although copper has a reddening effect and silver a greening effect, platinum has a blanching effect. The addition of platinum or palladium with a graying effect thus makes it possible to pass gradually from warm and lush colors in the case of the lowest contents through to more specialized, cooler colors in the case of the highest contents.

More particularly, a timepiece or jewelry part manufactured in an alloy comprising, by weight, at least 75% gold, between 20% and 22% copper, between 1.5% and 3% platinum and at most 0.5% of any one of the elements chosen from silver, cadmium, chromium, cobalt, iron, indium, manganese, nickel or zinc possesses a nominal color having, in the CIELAB space, an abscissa of 7.41 on the red/green axis, an ordinate of 15.67 on the yellow/blue axis and a contrast value of 86.75. Depending on the precise composition of the alloy, these coordinates may vary between 5.71 and 8.51 on the red/green axis and between 13.67 and 16.67 on the yellow/blue axis for a contrast value L varying between 76.75 and 96.75.

The invention applies to any timepiece or jewelry part manufactured from an alloy using the standard processes, such as machining, stamping or lost wax casting.

The invention claimed is:

1. A timepiece or jewelry part manufactured in an alloy consisting essentially of at least 75% gold and from 21% to 23% copper by weight, wherein the alloy comprises from 1% to 2.5% platinum with gold from 76.5% to 78%, or from 2.5% to 3% platinum with gold from 75% to 76.5%.

2. The timepiece of jewelry part as claimed in claim 1, wherein the alloy comprises from 21 to 22% copper by weight.

3. The timepiece or jewelry part as claimed in claim 1, wherein the alloy comprises, by weight, at most 0.5% of any one of at least one element selected from the group consisting of silver, cadmium, chromium, cobalt, iron, indium, manganese, nickel and zinc.

4. The timepiece of jewelry part as claimed in claim 3, wherein the alloy comprises from 21 to 22% copper by weight.

5. The timepiece or jewelry part as claimed in claim 3, wherein the alloy comprises, by weight, from 21% to 22% copper, from 1.5% to 3% platinum, and has a nominal color having, in the CIELAB space, an abscissa of from 5.71 to 8.51 on the red/green axis and an ordinate of from 13.67 to 16.67 on the yellow/blue axis for a contrast value L of from 76.75 to 96.75.

6. The timepiece or jewelry part as claimed in claim 5, wherein the alloy has a ΔELab of from 2.4 to 5.8.

7. The timepiece or jewelry part as claimed in claim 1, wherein the alloy has a ΔELab of from 2.4 to 5.8.

8. A timepiece or jewelry part manufactured in an alloy consisting essentially of:

at least 75% gold by weight, from 21% to 23% copper by weight, and from 1% to 4% platinum by weight.

9. The timepiece of jewelry part as claimed in claim 8, wherein the alloy comprises from 1 to 3% platinum by weight.

10. The timepiece of jewelry part as claimed in claim 9, wherein the alloy comprises from 21 to 22% copper by weight.

11. The timepiece or jewelry part as claimed in claim 10, wherein the alloy comprises, by weight, from 21% to 22% copper, from 1.5% to 3% platinum, and has a nominal color having, in the CIELAB space, an abscissa of from 5.71 to 8.51 on the red/green axis and an ordinate of from 13.67 to 16.67 on the yellow/blue axis for a contrast value L of from 76.75 to 96.75.

12. The timepiece or jewelry part as claimed in claim 11, wherein the alloy comprises, by weight, at most 0.5% of any one of the elements selected from the group consisting of silver, cadmium, chromium, cobalt, iron, indium, manganese, nickel and zinc.

13. The timepiece or jewelry part as claimed in claim 11, wherein the alloy has a ΔELab of from 2.4 to 5.8.

14. The timepiece or jewelry part as claimed in claim 11, wherein the alloy has a ΔELab of from 2.4 to 3.1.

15. The timepiece or jewelry part as claimed in claim 12, wherein the alloy has a ΔELab of from 2.4 to 5.8.

16. The timepiece or jewelry part as claimed in claim 12, wherein the alloy has a ΔELab of from 2.4 to 3.1.

17. The timepiece or jewelry part as claimed in claim 8, wherein the alloy has a ΔELab of from 2.4 to 5.8.

18. The timepiece or jewelry part as claimed in claim 8, wherein the alloy has a ΔELab of from 2.4 to 3.1.

* * * * *